United States Patent [19]

Boston et al.

[11] Patent Number: 4,557,953

[45] Date of Patent: Dec. 10, 1985

[54] PROCESS FOR CONTROLLING SNOUT ZINC VAPOR IN A HOT DIP ZINC BASED COATING ON A FERROUS BASE METAL STRIP

[75] Inventors: Steven L. Boston; Forrester Caudill, both of Middletown; Jerry L. Arnold, Franklin, all of Ohio

[73] Assignee: Armco Inc., Middletown, Ohio

[21] Appl. No.: 635,513

[22] Filed: Jul. 30, 1984

[51] Int. Cl.[4] ..... C23C 1/02

[52] U.S. Cl. ..... 427/432; 427/321

[58] Field of Search ..... 427/329, 383.7, 432, 427/433

[56] References Cited

U.S. PATENT DOCUMENTS

| | | | |
|---|---|---|---|
| 3,505,042 | 4/1970 | Sievert et al. | 29/196.2 |
| 3,505,043 | 4/1970 | Lee et al. | 29/196.2 |
| 4,053,663 | 10/1977 | Caldwell | 427/432 |
| 4,114,563 | 9/1978 | Schnedler et al. | 118/63 |
| 4,183,983 | 1/1980 | Cook | 427/433 |
| 4,239,817 | 12/1980 | Koenitzer et al. | 427/211 |
| 4,330,574 | 5/1982 | Pierson | 427/432 |
| 4,369,211 | 1/1983 | Nitto | 427/349 |
| 4,444,814 | 3/1984 | Flinchum | 427/432 |
| 4,466,999 | 8/1984 | Leonard | 427/329 |
| 4,478,892 | 10/1984 | Amberson | 427/320 |

FOREIGN PATENT DOCUMENTS

| | | |
|---|---|---|
| 1083437 | 8/1980 | Canada . |

*Primary Examiner*—Sam Silverberg
*Attorney, Agent, or Firm*—Frost & Jacobs

[57] ABSTRACT

A process for suppressing zinc vapor in the snout of a continuous line for hot dip coating one side or both sides of a ferrous base metal strip with a molten zinc or zinc based alloy by maintaining the atmosphere within the snout to include about 1-8% hydrogen by volume and about 300 ppm to 4500 ppm water vapor with the balance being one or more inert gases, such as nitrogen. The atmosphere has a hydrogen/water vapor ratio of at least 4 to 1, or higher. This atmosphere is oxidizing to zinc vapor but non-oxidizing to the ferrous strip.

14 Claims, 4 Drawing Figures

PROCESS FOR CONTROLLING SNOUT ZINC VAPOR IN A HOT DIP ZINC BASED COATING ON A FERROUS BASE METAL STRIP

TECHNICAL FIELD

This invention relates to a process for controlling or eliminating vaporization of molten zinc in the snout of a continuous galvanizing line where zinc or zinc alloys are employed as a hot dip coating on a ferrous base metal strip.

The present application is copending with U.S. patent application Ser. No. 635,512, titled "Process For Controlling Zinc Vapor In A Finishing Process For A Hot Dip Zinc Based Coating On A Ferrous Base Metal Strip" (commonly assigned).

BACKGROUND ART

In the galvanizing of steel, adherent zinc coatings depend upon the ferrous base metal strip entering the molten zinc based bath with the strip surface essentially free of oxide and dirt. Accordingly, after the strip is heated and cleaned in the galvanizing line furnace sections, a protective or non-oxidizing atmosphere is maintained about the strip prior to its entry into the zinc bath.

This protective or non-oxidizing atmosphere may have insufficient activity of oxygen necessary to prevent the formation of zinc vapor. Consequently, zinc vapor will migrate up into the entry section, cooling section, and various furnace sections of the galvanizing line. Generally the zinc vapor condenses in the entry and cooling sections, effecting a phase change into solid or liquid metallic zinc or zinc oxide, and accumulates on the various elements of the entry and cooling sections, and falls from the elements onto and alloys with the clean ferrous base metal strip. It is theorized that as zinc droplets fall on the strip, the outer surface of each droplet oxidizes forming a zinc droplet surrounded by a Zn oxide film. Upon impact of the droplet on the strip, the droplet flattens out and the zinc metal alloys with the ferrous strip, while the zinc oxide forms into a flake. The zinc oxide flake does not alloy with the ferrous strip nor does it strongly adhere to the iron-zinc alloy layer. Consequently, during immersion in the zinc coating metal, the spots created by the droplets are not adhered to by the molten zinc and after exiting the metering device they appear as non-uniform, uncoated portions on the strip. These coating defects are undesirable.

U.S. Pat. No. 4,369,211 to Nitto et al recognizes the problem of zinc vapor formation in a coating chamber, rather than the snout chamber. Specifically, Nitto et al maintain a controlled atmosphere of about 50–1000 ppm oxygen in the coating chamber which is sufficient to prevent zinc vapor formation.

Belgium Pat. No. 887,940 to Heurtey recognizes the problem of zinc vapor formation in the snout section. In particular, a sweep gas is employed, not to prevent zinc vapor formation, but to sweep over the hot dip zinc based bath surface and become loaded with zinc vapor. The loaded sweep gas is evacuated from the snout and undergoes condensation to recover the zinc based coating.

Neither Nitto et al nor Heurtey comprises an economical procedure for adequately suppressing zinc vapor formation in the snout. In particular, 50 ppm molecular oxygen described by Nitto et al may result in a thin oxide film on the clean ferrous base metal strip, which, if not dissolved in the coating pot by the zinc, can result in poor adherence of the zinc coating to the ferrous strip. With respect to Heurtey, employing a sweep gas and treating it to recover zinc or zinc oxide is especially costly, requiring additional personnel and additional maintenance.

Accordingly, there exists a need for a process to suppress zinc vapor formation which does not require additional costly equipment and maintenance, nor yield coating defects because of poor adherence.

SUMMARY OF THE INVENTION

The present invention is based upon the discovery that the formation of zinc vapor in the snout of a hot dip zinc coating operation on a ferrous base metal strip can be controlled by injecting a high dew point gas such as steam, wet $H_2$, wet $N_2$, or other wet inert gases, or mixtures thereof into the snout, while simultaneously maintaining a minimum 4 to 1 ratio of hydrogen to water vapor in the atmosphere of the snout, and thus suppressing the formation of zinc vapor by reacting the zinc vapor with water to form zinc oxide and hydrogen gas ($Zn+H_2O \rightarrow ZnO+H$). Although the injected gas is a high dew point gas the atmosphere within the snout cannot be oxidizing to the strip.

The hydrogen and water vapor are maintained in a minimum 4 to 1 $H_2/H_2O$ ratio and preferably are maintained at a 6 to 1 $H_2/H_2O$ ratio. Generally the hydrogen gas comprises about 1–8% by volume of the atmosphere in the snout, while the water vapor is generally within the range of 300 ppm to about 4500 ppm, which corresponds to a frost point of −29° F. to +25° F. If an atmosphere contains greater than 4% hydrogen by volume, care must be exercised to prevent escape of the atmosphere into ambient air because it may flash.

In the broadest sense, the present invention comprises a process for continuously hot dip coating a ferrous base metal strip with zinc or zinc based alloys which includes providing an entrance snout for the entering strip to the coating bath, wherein the improvement includes maintaining an atmosphere within the entrance snout which is oxidizing to the zinc vapor but non-oxidizing to the ferrous strip.

The process of the present invention will be more fully described in the following description.

DESCRIPTION OF THE PREFERRED EMBODIMENTS

Figure 1:
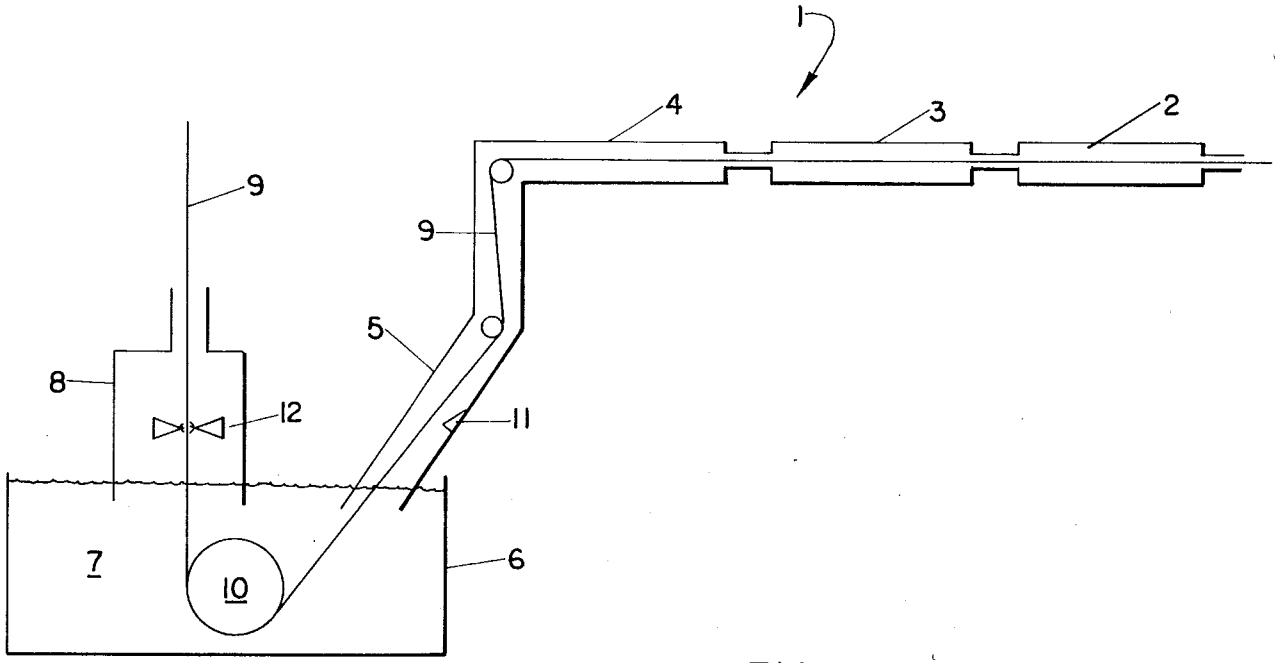
FIG. 1 is a diagrammatic sectional view of either a one-sided or a two-sided galvanized coating process.

FIG. 1 shows the invention of the present application in a typical high speed galvanizing line. Any of the well known galvanizing lines such as a Selas or Sendzimir type, or modifications thereof, are applicable to the present invention. FIG. 1 depicts a Selas galvanizing line 1 having a direct fired preheat furnace section 2, controlled atmosphere radiant heat furnace section 3, cooling section 4, and the entry section or snout 5. The snout is submerged in the zinc bath 7 contained in coating pot 6. Ferrous strip 9 passes from snout 5 into zinc bath 7 around pot roll 10 and exits up through a pair of jet finishing nozzles 12 in coating chamber 8. Optionally, coating chamber 8 may be removed.

Dirt, oils, and oxides are removed from the strip in furnace 2 using a non-oxidizing atmosphere of fuel and air. The atmosphere in furnace section 3 through the balance of the line is preferably a $H_2$—$N_2$ atmosphere generally having 1–30% by volume $H_2$.

In operation, the ferrous base metal strip 9 enters the bath area through entrance snout 5 from a furnace, which typically heats the ferrous base metal strip to a temperature of about 1000° F. to as high as 1650° F., and is then cooled to approximately 860° F. just before entering entrance snout 5. If a one-sided coating process is being conducted, then one side of the ferrous base metal strip may be physically or chemically masked, such that only one side of the ferrous strip is actually coated when submerged in the molten metal. Later, the physical or chemical mask is removed as is well known in the art. If a two-sided process is being conducted, it is only necessary to submerge the ferrous strip in the molten metal such that both sides of the strip are coated.

When the ferrous base metal strip 9 is submerged into the molten zinc base metal 7, roller 10 directs the strip upwardly into coating chamber 8. As the strip emerges from the molten bath 7, a pair of jet finishing nozzles 12 direct a jet of non-oxidizing gas, such as nitrogen, upon both sides of the ferrous base metal strip which serves to prevent the development of edge berries, feathered oxides and spangle relief, in addition to providing a uniform coating on the ferrous base metal strip, before it exits from the coating chamber. For air finishing operations, coating chamber 8 can be removed and oxidizing gas such as air can be employed in nozzles 12.

To prevent zinc vapor formation within snout 5, an atmosphere containing water vapor, hydrogen and preferably one or more inert gases, such as nitrogen, is maintained within the snout. While it may typically only be necessary to inject water vapor through nozzle 11, because hydrogen and nitrogen are typically already in the snout, it is preferred to additionally inject other gases. Thus, the water vapor is typically introduced into the snout by a wet gas, such as wet hydrogen or nitrogen or a mixture of these, but it can also be introduced by steam. Consequently, the preferred atmosphere in snout 5 comprises about 1–8% hydrogen by volume and about 300 ppm–4500 ppm water vapor with the balance being essentially nitrogen. The hydrogen/water vapor ratio for the preferred atmosphere should be a minimum of at least 4 to 1, and more preferably, at least 6 to 1.

Of course, the water vapor will oxidize the molten zinc metal surface within snout 5 forming a zinc oxide surface layer. This layer acts as a barrier by hindering any zinc metal making its way to the surface, thus aiding in the suppression of zinc vapor formation.

Maintaining a snout atmosphere which is oxidizing to zinc vapor but non-oxidizing to the ferrous strip is critical. If less than about 300 ppm water vapor is present within snout 5, insufficient water vapor exists to suppress zinc vapor formation. As a practical matter, the atmosphere of snout 5 can contain practically any amount of hydrogen, but because hydrogen is significantly more costly than nitrogen, it is preferred to have about 1–8% by volume hydrogen. Generally, because less than about 300 ppm water vapor is the approximate minimum working amount, the minimum hydrogen would be about 1200 ppm in order to maintain the minimum 4/1 ratio. The reason the minimum preferred amount of hydrogen is about 1% by volume is because hydrogen helps maintain a reducing atmosphere in snout 5. The reducing atmosphere aids in preventing the oxidation of the ferrous strip.

Figure 2:
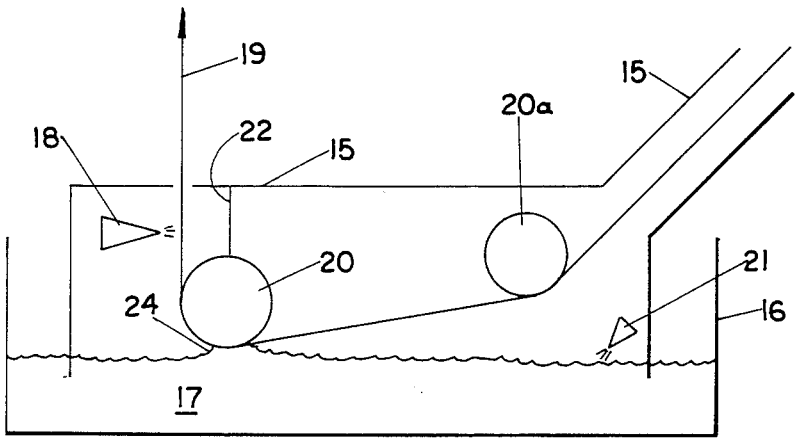
FIG. 2 is a diagrammatical sectional view of a one-sided galvanized coating process.
Figure 3:
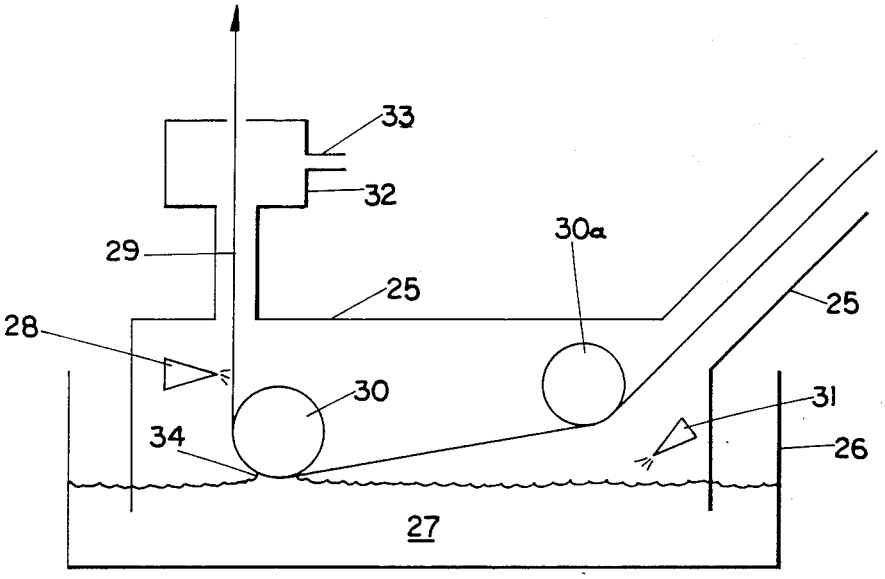
FIG. 3 is a diagrammatical sectional view of another one-sided galvanized coating process.

The above snout parameters are identical for either the one-sided or two-sided coating process for snout 5 of FIG. 1 and for snouts 15 and 25 of FIGS. 2 and 3.

Both FIGS. 2 and 3 illustrate a meniscus type one-sided coating process wherein a coating pot 16, 26 contains a zinc based molten metal 17, 27. The ferrous base metal strip 19, 29 is introduced into the coating pot through a snout chamber 15, 25 which extends over substantially all the surface area of the molten metal 17, 27. The ferrous strip is directed somewhat horizontally by roll 20(*a*), 30(*a*) such that a meniscus 24, 34 will be formed under roll 20, 30. The ferrous strip 19, 29 is treated by jet finishing nozzle 18, 28 all of which is well known as set forth in U.S. Pat. No. 4,114,563 to Schnedler.

With respect to FIG. 2, a sealing device 22 extends between the roof of the snout chamber 15 and the outer periphery of roll 20. The sealing device is necessary for two major reasons: (1) an atmosphere, issuing from nozzle 21, containing about 4% or more, by volume, hydrogen is within the flashpoint composition range and may flash when exposed to air; thus sealing device 22 serves to prevent a snout atmosphere which may contain higher than 4% by volume hydrogen from being exposed to the atmosphere; and (2) the ambient air may contain sufficient free oxygen capable of oxidizing strip 19; thus sealing device 22 serves to maintain the desired low amount of free oxygen within the snout chamber.

In the FIG. 3 modification, no sealing device is employed. Thus, if nozzle 31 is injecting wet gas containing, for example, 8% by volume hydrogen, then means must exist to prevent flashing of the gas when exposed to the atmosphere through the slit in the roof of snout chamber 25. Accordingly, a reservoir 32 is maintained with inert gas, such as nitrogen, by means of inlet 33. The reservoir serves to dilute the atmosphere exiting from the coating chamber so that the exiting gas contains no more than 4%, by volume, hydrogen, and preferably no more than 3% by volume hyrogen.

In the operation of the FIG. 3 device, water vapor can be injected into the snout chamber 25 through nozzle 31 to suppress vapor as taught by co-pending U.S. patent application Ser. No. 635,512, filed concurrently herewith, if a minimum $H_2/H_2O$ ratio of 4/1 is maintained.

Figure 4:
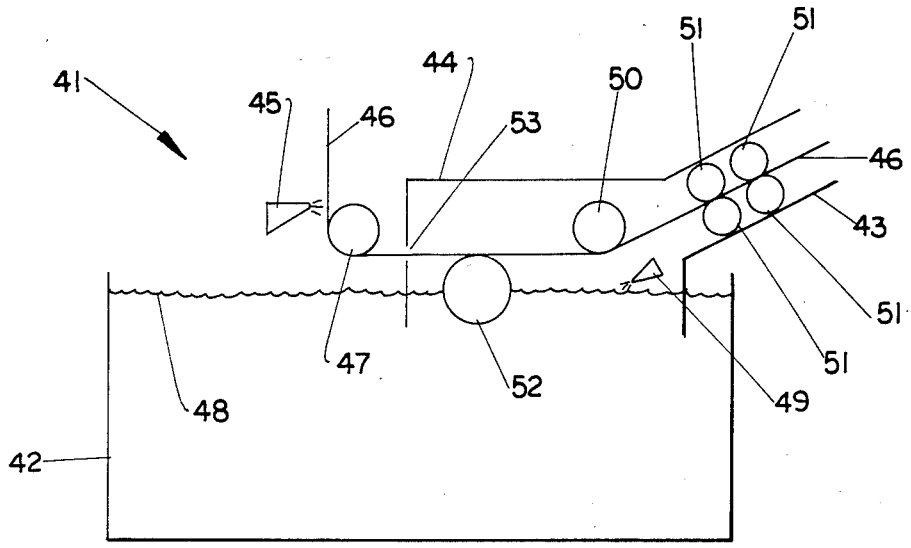
FIG. 4 is a diagrammatical sectional view of yet another one-sided galvanized coating process.

In FIG. 4, reference numeral 41 represents yet another one-sided coating modification of the present invention. Coating pot 42 contains a zinc based metal having a surface 48. The snout comprises a snout duct 43 and a snout chamber 44. The atmosphere in the snout duct is maintained separate from the snout chamber by means of sealing rolls 51. Each roll extends from the ferrous base metal strip 46 to the snout duct 43. The sealing rolls 51 serve a purpose similar to that of sealing device 22, that is, they prevent the snout duct atmosphere, which may contain hydrogen gas at or above the flash point composition, from being exposed to the ambient atmosphere present in snout chamber 44. The atmosphere within snout chamber 49 is directly effected by the wet gas or gases issuing from nozzle 49, like the water vapor issuing from nozzle 11 of the FIG. 1 device.

In operation, the ferrous base metal strip 46 passes between pairs of sealing rolls 51 and enters snout chamber 44. Roll 50 performs in much the same manner as roll 20(*a*) or 30(*a*) in FIG. 2 or 3, respectively, by directing the strip 46 in a more horizontal manner so that it will cross over the top of coating roll 52. As roll 52 rotates, it dips into the molten zinc bath 48 and transfers molten zinc to one side of the strip 46. After the strip has been coated, it exists snout chamber 44 through slot opening 53. Roll 47 directs the ferrous strip 46 upwardly past jet finishing nozzle 45 in the conventional manner. Note that excessive zinc coating drops back into coating pot 42 when the ferrous strip 46 is being finished by nozzle 45.

The following examples further illustrate the features and characteristics of the present invention.

EXAMPLE 1

1800 cubic feet/hour dry $N_2$ was injected into the inlet 11 such as that shown in FIG. 1. The atmosphere contained 3% hydrogen by volume, less than 10 ppm molecular oxygen, approximately 127 ppm water vapor corresponding to a frost point of −40° F., with the balance being nitrogen. Three samples were extracted from the snout by means of a pump set at 0.5 liters per minute. The total sample time for each sample was 30 minutes. The ferrous strip temperature was 890° F. The three samples indicate that the amount of zinc vapor in the snout atmosphere was 64 mg/m$^3$, 72 mg/m$^3$ and 73 mg/m$^3$.

EXAMPLE 2

66 cf/h wet $N_2$ was injected through inlet 11. The resulting atmosphere contained 3.2% hydrogen by volume, less than 10 ppm molecular oxygen, approximately 127 ppm water vapor with a frost point of −40° F., with the balance being nitrogen. Three samples were extracted from the snout by means of a pump set at 0.5 liters/min. Sample time was 30 minutes per sample with ferrous strip temperature from 890° to 895° F. The three samples indicated that zinc vapor was present in the snout in the amounts of 44 mg/m$^3$, 41 mg/m$^3$ and 48 mg/m$^3$.

EXAMPLE 3

167 cf/h wet $N_2$ was injected through inlet 11. The resulting atmosphere contained 1.5% hydrogen by volume, less than 10 ppm oxygen, approximately 247 ppm water vapor with a frost point of −29° F., the balance being nitrogen. The extraction pump was set as in Examples 1 and 2. Sample time was 30 minutes with a ferrous strip temperature of approximately 880° F. Only one sample was taken which indicated there was 7 mg/m$^3$ of zinc vapor in the snout atmosphere. The reduction of zinc in the atmosphere is very clear from the results of this experiment.

EXAMPLE 4

After applying 170 cf/h wet $N_2$ into the snout for about 24 hours, the wet $N_2$ was turned off and dew point went from −22° F. to −51° F. Two 30 minute samples of the atmosphere were taken and the readings of zinc concentration were 52 and 70 mg/m$^3$, respectively. We then added 170 cf/h wet $N_2$ into the snout again and took two atmosphere samples. Dew point started rising from −50° F. to −40° F. The samples yielded 12 mg/m$^3$ and 10 mg/m$^3$ zinc vapor, respectively. $H_2$ was 8–9% by volume.

EXAMPLE 5

Piping changes allowed us to explore above 200 cf/h wet $N_2$. We checked zinc concentration in snout while introducing 200 cf/h wet $N_2$. Dew point was −37° F. to −47° F. Zinc concentration was 7 mg/m$^3$ in both samples. Wet $N_2$ flow was increased to 300 cf/h (dew point increased to −26° F.) and zinc concentration was measured 2 more times. Test yielded 1 mg/m$^3$ in both samples. $H_2$ was 3–4% by volume.

In Examples 2–5, the zinc based coated ferrous strip contained no edge berries, feathered oxides, spangle relief or poor adherence. Consequently, the use of a wet gas or gases to supress zinc vapor in the snout does not cause any detrimental effects on the coated ferrous strip and cures the problem described previously.

What is claimed is:

1. A process for suppressing zinc vapor formation in a continuous hot dip coating process having a hot dip coating consisting essentially of zinc, wherein the strip is enclosed in an entrance snout, comprising the step of maintaining an atmosphere within said entrance snout which is oxidizing to said zinc vapor but not oxidizing to said ferrous strip, said atmosphere within said entrance snout including a minimum 4:1 hydrogen/water vapor ratio.

2. The process of claim 1, wherein said atmosphere within said entrance snout preferably comprises about 1–8% hydrogen by volume and about 300 ppm to 4500 water vapor with the balance being essentially an inert gas or gases.

3. The process of claim 2, wherein said inert gas is nitrogen.

4. The process of claim 1 wherein said atmosphere within said entrance snout has a dew point of +70° F. (2.47% water vapor by volume) with a hydrogen content of 10%, by volume.

5. The process of claim 1, wherein said atmosphere comprises about 1–8% hydrogen by volume and about 300 ppm to 4500 ppm water vapor with the balance being essentially an inert gas or gases.

6. The process of claim 5, wherein said inert gas is nitrogen.

7. The process of claim 1, wherein said step of maintaining an atmosphere includes adding wet nitrogen.

8. The process of claim 1, wherein said atmosphere within said entrance snout has $\geqq$264 ppm $H_2O$.

9. The process of claim 1, wherein said atmosphere within said entrance snout has $\leqq$4360 ppm $H_2O$.

10. The process of claim 1, wherein said atmosphere within said entrance snout contains 1% hydrogen by volume.

11. The process of claim 1, wherein said atmosphere within said entrance snout contains 8% hydrogen by volume.

12. The process of claim 1, wherein both sides of said ferrous base metal strip are coated.

13. The process of claim 1, wherein only one side of said ferrous base metal strip is coated.

14. The process of claim 1, wherein said atmosphere within said entrance snout contains a 6 to 1 hydrogen/-water vapor ratio.

* * * * *